United States Patent [19]

Steadings et al.

[11] Patent Number: 4,754,520

[45] Date of Patent: Jul. 5, 1988

[54] AUTOMATICALLY ADJUSTABLE FLOATING CLEANER HEAD

[75] Inventors: Stephen W. Steadings, Seneca; James F. Barnes, Anderson, both of S.C.

[73] Assignee: The Singer Company, Stamford, Conn.

[21] Appl. No.: 89,798

[22] Filed: Aug. 27, 1987

[51] Int. Cl.[4] ..... A47L 5/34

[52] U.S. Cl. ..... 15/319; 15/340; 15/360; 15/362

[58] Field of Search ..... 15/340, 359, 360, 362, 15/319

[56] References Cited

U.S. PATENT DOCUMENTS

| | | | |
|---|---|---|---|
| 2,232,766 | 2/1941 | Boyle | 15/362 |
| 2,244,132 | 6/1941 | Taylor | 15/360 |
| 2,291,250 | 7/1942 | Nielsen et al. | 15/359 |
| 2,592,710 | 4/1952 | Kirby | 15/319 |
| 4,171,554 | 10/1979 | Tschudy | 15/359 |
| 4,342,132 | 8/1982 | Fromknecht | 15/339 |
| 4,615,071 | 10/1986 | Frohbieter | 15/340 |

FOREIGN PATENT DOCUMENTS 528913 11/1940 United Kingdom ..... 15/360

*Primary Examiner*—Chris K. Moore

*Attorney, Agent, or Firm*—David L. Davis

[57] ABSTRACT

A floating cleaner head used with a self-propelled front wheel drive floor cleaning apparatus, such as a vacuum cleaner. Both the forwardly located drive wheels and the drive transmission therefor are pivotably mounted on a bracket beneath the cleaner head. A skid plate attached to the bracket extends rearwardly from the bracket pivot to sense the carpet pile height of a floor to be cleaned. As the pile height increases, the bracket is pivoted so as to force the drive wheels deeper into the carpet pile which increases the propelling force. Additionally, since the drive wheels and transmission are located intermediate freely-rotatable rear wheels and a forwardly located rotary brush and nozzle area, operation of the skid plate also cause the entire cleaner head to float or pivot about the axis of the rear wheels so as to automatically adjust the elevation of the rotary bar and nozzle area. Furthermore, by making practical a front wheel drive, the need for neutral interlock for transport of the cleaner from room to room is eliminated since the rear support wheels are freely rotatable.

19 Claims, 2 Drawing Sheets

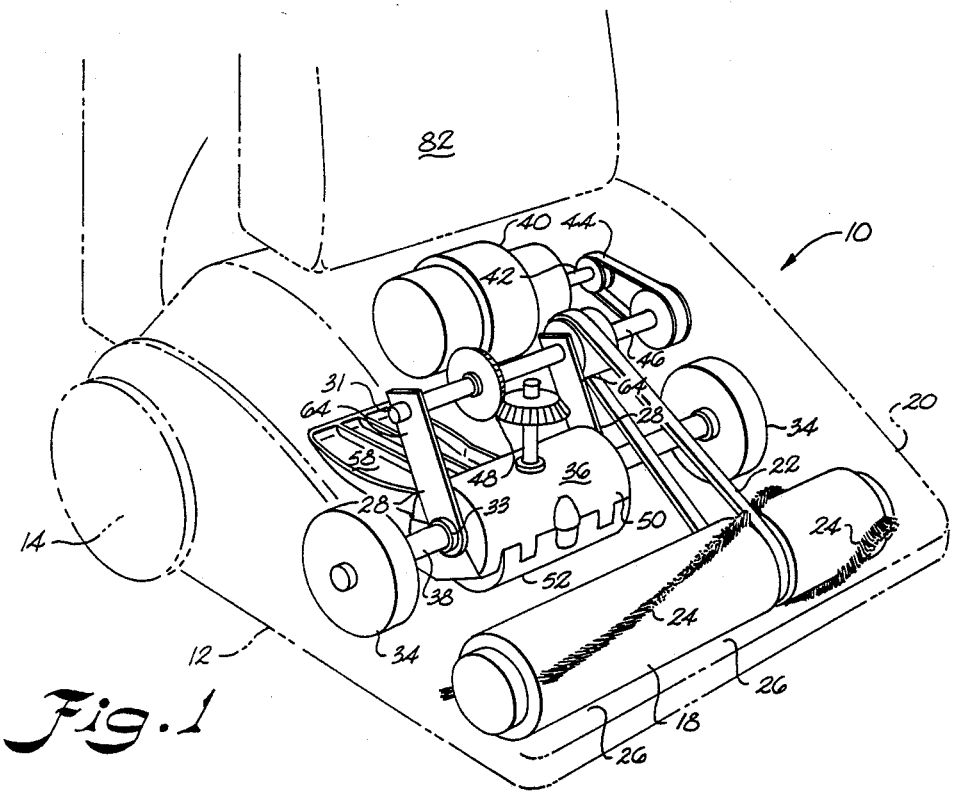
Fig. 1
Fig. 2
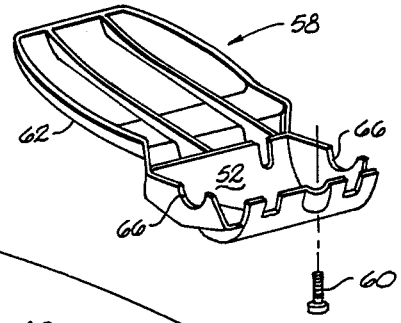
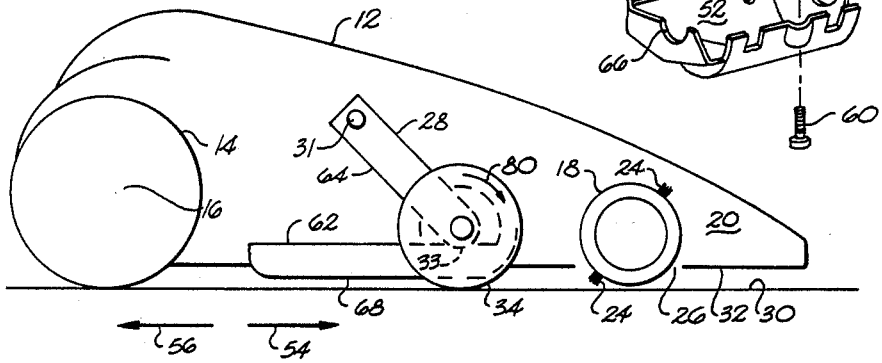
Fig. 3

AUTOMATICALLY ADJUSTABLE FLOATING CLEANER HEAD

BACKGROUND OF THE INVENTION

This invention concerns in general a floating cleaner head arrangement, and in particular an automatically adjustable floating cleaner head for use with a self-propelled front wheel drive floor cleaning apparatus, such as an upright vacuum cleaner.

Certain types of floor cleaning devices utilize cleaner heads which typically have vacuum nozzle areas located on the underside thereof adjacent a floor to be cleaned. As is generally known in the art, optimum nozzle height elevations above the floor to be cleaned are desirable to obtain maximum air flow through the nozzle, which flow is of course directly related to the cleaning performance of the machine. Since modern floor coverings can have various pile heights, ranging anywhere from low pile or bare floor to plush to shag, it is generally known to vary the chassis elevation so as to locate the vacuum nozzle areas a particular level above the surface to be cleaned depending on the particular type of carpet or floor covering.

One example of a cleaner head which may be adjusted for various carpet pile heights or thicknesses is illustrated by U.S. Pat. 4,342,132, issued to Fromknecht on Aug. 3, 1982, and commonly assigned with the present application. Fromknecht has a rearwardly located pile height foot or plate 40 for automatically sensing and indicating the pile height and density. Sensor foot 40 is connected via a cable with an indicator assembly 50 so that a user may perceive the sensed pile height and select a nozzle height accordingly. The user may then rotate a knob 34 to manually vary the nozzle height by adjusting the height of rear wheels 30.

Another example of a suction cleaner, and for which the nozzle thereof is more automatically maintained at a correct height, is disclosed by U.S. Pat. No. 2,244,132, issued to Charles H. Taylor on Jun. 3, 1941. Pile height sensing wheels are used to automatically influence the height of forwardly arranged cleaner supporting wheels, which serves to in turn influence the brush and nozzle height. In the Taylor mechanism, the supporting wheel height is influenced in the same direction as is the pile height sensing wheel.

Neither of the foregoing exemplary patents are directed to self-propelled units. Typically, self-propelled cleaners have rotatably driven drive wheels which are located generally rearwardly on the cleaner head. Several drawbacks arise with such an arrangement. For example, to transport the cleaner from room to room, in the case of an upright vacuum cleaner the cleaner is tipped back onto its rear wheels for transportation. If the rear wheels are adapted to be driven, such transport operation requires inclusion of a neutral clutch position for the driven rear wheels so that they will freely rotate during transport. Otherwise, movement of the unit would tend to be difficult if not impossible since rotation of the wheels with the drive motor therefor turned off would require overcoming friction within the clutches and gears of its transmission system.

Another drawback of typical prior self-propelled units is that the propelling force obtained with the drive wheels thereof is diminished in general as the height of the carpet pile to be cleaned increases. Without adjustment of such propelling force to compensate for varying characteristics of different floor surfaces, unsatisfactory performance of the selfpropelled feature can occur.

SUMMARY OF THE INVENTION

The present invention recognizes and addresses such drawbacks of prior devices, as well as other drawbacks and disadvantages thereof. Accordingly, it was one general object of the present invention to provide an improved floating cleaner head. It is a more particular object of this invention to provide such a floating cleaner head which automatically regulates the propelling force of a self-propelled cleaning unit, and which automatically adjusts the relative height elevation of a vacuum nozzle area of the cleaner head, all responsive to sensed variations in the carpet pile height to be cleaned.

It is another more general object of this invention to provide a practical front wheel drive self-propelled unit. In providing such unit, it is a more particular object to provide a front wheel drive unit with a floating head which is automatically adjusted for sensed variations in carpet pile height and which automatically applies more downward pressure to the front drive wheels responsive to increasing carpet pile heights. Such greater downward force or pressure on the front drive wheels increases the amount of propelling force obtained therewith, so that the propelling force of a self-propelled unit may be automatically regulated responsive to variations in the carpet pile height.

It is yet another object of the present invention to provide such an improved floating cleaner head which is self-adjusting over a wide range for use with virtually all floor coverings presently available in the marketplace. For example, a construction in accordance with the present invention may be practiced with floor coverings ranging from a bare floor or low pile to a plush carpet (approximately $\frac{3}{4}$ inch pile height) to a shag carpet (approximately $1\frac{1}{4}$ or higher inch pile height). In providing an automatically adjustable floating cleaner head which may be operated in connection with carpet pile heights over such a range, it is a further general object of the present invention to provide such a cleaning unit which is continuously responsive over and within such range to sensed analog variations in the carpet pile height so that propelling force and beater bar brush and vacuum nozzle elevation are also continuously varied over a determined range for optimized performance.

While various embodiments in accordance with the present invention may be provided as constructions which include various combinations of presently disclosed features, one exemplary construction of a floor cleaning apparatus having a floating cleaning head in accordance with the present invention comprises: a chassis; first support wheels, mounted generally rearwardly on the chassis, and having a substantially fixed axis of rotation; a vacuum nozzle region, located generally forwardly on the chassis; second support wheels, mounted on the chassis intermediate the first support wheels and the vacuum nozzle region, and having a movable axis of rotation which is movable in a substantially vertical plane relative a floor to be cleaned and on which the cleaning head is adapted to be received; drive means for controllably rotating such second support wheels so as to propel the chassis over a floor to be cleaned; and automatic regulation means for varying the amount of propelling force transmitted through such second support wheels from the drive means to a floor to be cleaned, responsive to variations in the carpet pile height of such floor.

Another exemplary construction in accordance with this invention may be directed to a floating cleaner head for a self-propelled vacuum cleaner, comprising: a main chassis adapted to be pivoted about a rearwardly located first axis thereof; a rotary brush and vacuum nozzle means situated generally adjacent the front of such chassis; freely-rotatable rear wheels for supporting the chassis, such rear wheels having a fixed axis of rotation coincident with the chassis first pivot axis; pivoting bracket means, pivotably supported on the chassis about a second axis thereof located intermediate the rear wheels and the chassis front; drive wheels for further supporting the chassis and drive transmission means for controllably driving the drive wheels so as to propel the chassis relative a floor to be cleaned, both the drive wheels and the drive transmission means being supported on the pivoting bracket means for movement therewith; and sensor plate means, associated with the pivoting bracket means for automatically pivoting same about the chassis second axis responsive to varying carpet pile height on which the cleaner head is used so as to in turn adjust the position of the drive wheels relative the chassis, whereby the drive wheels are pivoted deeper into the carpet pile with corresponding increases in such carpet pile height so as to provide increased propelling force.

Yet another exemplary embodiment incorporating features of this invention is directed to a self-propelled upright vacuum cleaner having a floating cleaning head for automatic height adjustment thereof, comprising: a generally planar chassis member adapted to be received on and propelled over a floor to be cleaned; a control handle for controlling the vacuum cleaner and supporting a dust bag mounted thereon, the handle being pivotably attached to the chassis member for guiding same from a generally upright position; rear support wheels for the chassis member, such rear wheels having a fixed rotation axis; a vacuum nozzle area located adjacent the front of the chassis member; a rotary beater bar brush situated in the vicinity of the vacuum nozzle area; a support bracket pivotably mounted on the chassis member about a pivot axis situated parallel to the fixed rotation axis of the rear support wheels and located forwardly thereof, the bracket having a free pivoting end which projects generally forwardly of the pivot axis thereof; drivable support wheels for the chassis member, secured on the bracket free pivoting end for pivoting movement therewith relative the chassis member and a floor to be cleaned; drive transmission means, also supported on the bracket free pivoting end, in operative association with the drivable support wheels for controllably rotating same so as to propel the chassis member relative a floor to be cleaned; a substantially rigid sensing member attached to the bracket at a fixed angle, and extending rearwardly of the pivot axis thereof and generally parallel with a floor to be cleaned, the sensing member being adapted for contacting carpet pile of a floor to be cleaned and thereby pivot the bracket about the pivot axis thereof to a degree corresponding with the relative thickness of the contacted carpet pile; whereby the bracket free pivoting end is pivoted downward with increasing carpet pile thickness so as to push the drivable support wheels deeper into such relatively thicker pile carpets, which relatively increases the propelling force obtained with the drivable support wheels in thicker pile carpets while also tending to pivot the front of the chassis member upward about the fixed axis of the rear support wheels so as to relatively raise the front rotary brush and vacuum nozzle area for such thicker pile carpets, and vice versa.

Various modifications and variations to the presently disclosed exemplary embodiments of features in accordance with the present invention may be practiced by those of ordinary skill in the art. All such variations are intended to come within the spirit and scope of the present invention by virtue of present reference thereto.

BRIEF DESCRIPTION OF THE DRAWINGS

A full and enabling disclosure of the present invention, including the best mode thereof, is set forth more particularly in the remaining portion of the specification, together with reference to the accompanying drawings, in which:

FIG. 1 rllustrates a partially transparent perspective view of an exemplary floating cleaner head in accordance with the present invention;

FIG. 2 illustrates an exemplary carpet pile height sensing member for use with the FIG. 1 embodiment; and FIGS. 3–5 illustrate side schematic views of the self-regulating features of the present invention responsive to varying floor conditions, including bare floor, plush, and shag carpet pile heights, respectively.

Figure 4:
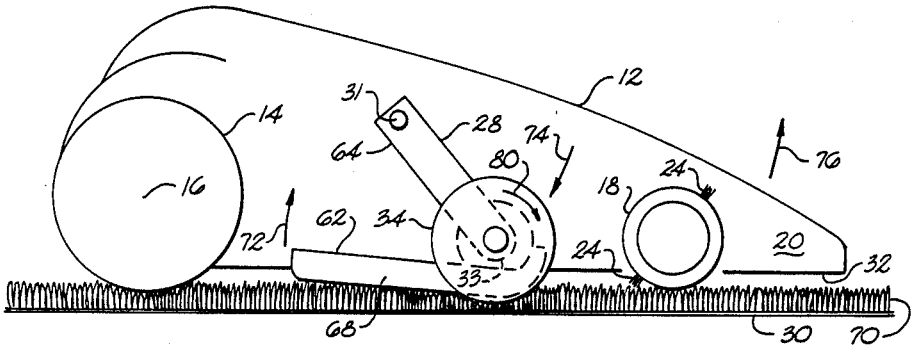

Repeat use of reference characters throughout the present specification and accompanying drawings is intended to represent same or analogous features or elements of this invention.

DETAILED DESCRIPTION OF THE PREFERRED EMBODIMENT

Referring now to the figures, a floating cleaner head 10 of a floor cleaning apparatus such as an upright vacuum cleaner includes a main chassis 12 (illustrated in see-through dotted lines in FIG. 1). The chassis during normal use is in part supported on a pair of freely-rotatable rearwardly located wheels 14 (only one of which is illustrated). The rear wheels preferably have a generally fixed axis of rotation 16, about which chassis 12 may also be pivoted for proper positioning (i.e. elevation control) of a beater bar brush and vacuum nozzle area thereof as discussed in greater detail below.

A generally conventional type beater bar brush 18 is rotatably received in a bearing or the like (not shown) as understood by those of ordinary skill in the art, which is situated adjacent a forward or front portion 20 of chassis 12. Rotary brush 18 may be driven through means of a belt 22 or the like, and has brush fingers 24 which agitate the floor to be cleaned for loosening dirt therefrom, as is generally known in the art. Of course, the drive belts disclosed herein may be variously substituted with gear drive systems or the like, or other functional equivalents thereof. The underside of chassis 12 is provided with a vacuum nozzle area 26 in the vicinity of which rotary brush 18 is journaled. Such vacuum nozzle arrangements are well known in the art and need not be discussed in detail herewith for a full and enabling understanding of the present invention. In keeping with conventional practices, vacuum nozzle area 26 is preferably interconnected with vacuum sources (not shown) for establishing an air flow between floor 30 and the underside 32 of a cleaning head (see for example FIG. 3). As mentioned above, maintaining an optimum height elevation for rotary brush 18 and vacuum nozzle region 26 is one general object of this invention which is accomplished by automatically regulating the distance between floor 30 and chassis underside 32 as discussed in greater detail below with respect to features of the exemplary embodiment.

The general configuration of chassis 12 and features thereof discussed above in combination with mechanisms situated intermediate rear wheels 14 and chassis front portion 20 provide for automatic adjustment features of the present invention. In particular, pivoting bracket means 28 includes a pivot axis 31 thereof, the position of which is preferably fixed relative chassis 12 (with various supports on chasis 12, not shown) and situated parallel with rotation axis 16 and other axes mentioned herein. A free pivoting end 33 of bracket means 28 extends generally forward of pivot axis 31 and supports thereon a pair of front or drive wheels 34. Front wheels 34 cooperate with rear wheels 14 for supporting chassis 12 on a floor or surface to be cleaned.

Additionally, wheels 34 may be controllably driven by a transmission means 36 which surrounds a central drive axle or shaft 38 passing between the two drive wheels 34. Such axle 38 preferably comprises a movable axis of rotation for wheels 34 which is movable in a substantially vertical plane since such wheels together with axle 38 and drive transmission means 36 are supported on the pivoting, free ends 33 of pivoting bracket means 28 for movement therewith, as more particularly illustrated below with reference to FIGS. 3–5.

Drive transmission means 36 may be externally powered by a central drive motor 40 (such as an electric motor fixedly supported on chassis 12) through a series of belts and pulleys or equivalent structures. In the exemplary configuration of the embodiment of FIG. 1, a main output shaft 42 of motor 40 is coupled through a pulley belt 44 with a secondary shaft 46. The precise position of belt 44 on shaft 46 may be varied; for example, a placement thereof axially inboard of bracket means 28 may be practiced instead of the axially outboard position illustrated. Such secondary shaft provides drive power to both belt 22 for rotating brush 18 and to a bevelled gear arrangement 48 for driving transmission means 36. The transmission means is preferably encased within an upper cover 50 and a lower member 52, which may comprise a portion of a carpet pile height sensing member in accordance with the present invention (see FIG. 2).

Various particular mechanisms for comprising a suitable transmission means may be selected by those of ordinary skill in the art and encased within members 50 and 52. For example, a combination of controllable clutches and reduction gears may be used for selectively engaging drive shaft 38 for rotation of wheels 34 in either a forward drive direction or a reverse drive direction. Such controlled rotatable driving of wheels 34 obviously propels chassis 12 in either the forward direction 54 or reverse direction 56 thereof (see FIG. 3). Automatic regulation of the degree of propelling force in accordance with sensed carpet pile height is achieved with practice of the present invention, as particularly discussed below.

Sensing member 58 includes a first cupped or cradle-shaped portion 52 for enclosing the underside of transmission means 36, as is illustrated by the configuration of present FIG. 1. As better illustrated in present FIG. 2, an attachment means such as a bolt 60 or equivalents thereof may be used to preferably fixedly secure sensor member 58 to the transmission means 36 or the pivoting bracket means 28. The precise manner in which sensing member 58 is attached to the pivoting apparatus of the present invention may vary for different embodiments, so long as in general a fixed relationship is established between a rearwardly extending portion 62 and bracket arms 64. With such fixed mounting of sensing member 58 relative the free pivoting end 33 of bracket means 28, the generally planar rearwardly extending portion 62 of sensing member 58 may be used to pivot bracket means 28 about pivot axis 31 thereof responsive to variations in the carpet pile height contacted by planar member 62. Sensing member 58 may be variously configured for achieving such functions, but in the exemplary embodiment of present FIG. 2 comprises an integrally formed molded plastic part which attaches to the bottom side of the transmission means (or housing therefor) and includes side openings 66 to permit passage of drive shaft 38 therethrough.

Figure 5:
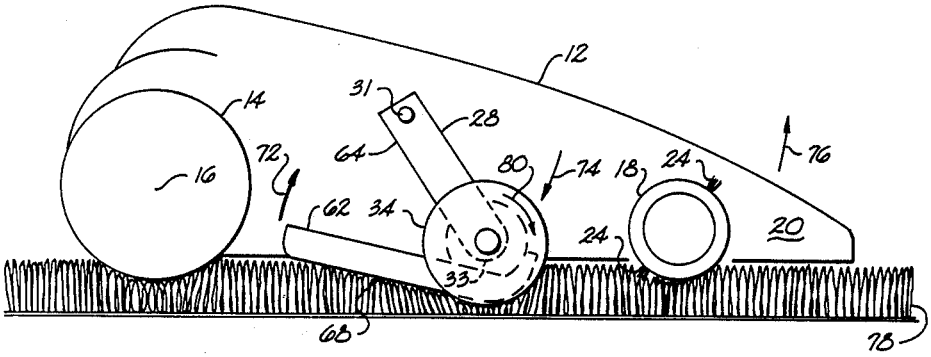

Referring now to present FIGS. 3 through 5, automatic regulation of propelling force responsive to varying carpet pile height, and corresponding automatic height elevation adjustment of rotating brush 18 and vacuum nozzle area 26, is discussed in detail. FIG. 3 represents use of floating chassis 12 on a bare floor or very low pile carpet. In such instance, the underside 68 of the rearwardly extending portion of the sensing member is generally parallel to and slightly separated from floor 30. An initial separation of approximately $\frac{1}{4}$ inch is preferred. With the configuration of present FIG. 3, the height elevation of rotating brush 18 and vacuum nozzle area 26 is established by the pivot angle of arm 64 (which supports wheels 34 in contact with floor 30) relative the axis 16 about which the front portion 20 of chassis 12 is pivotable.

FIG. 4 illustrates the conditions assumed by various mechanisms of a floating cleaner head in accordance with the present invention when used on a floor covering having an increased carpet pile height relative that represented by present FIG. 3. For example, a plush style carpet having a pile depth of approximately $\frac{3}{4}$ inch is represented by carpet pile 70. Since the height of carpet pile 70 exceeds the initial $\frac{1}{4}$ inch clearance described above with reference to FIG. 3, the underside 68 of planar member 62 is urged upwardly in the direction of arrow 72. Since planar member 62 has a fixed angular relationship with respect to bracket arm 64, as discussed above, planar member 62 is thereby pivoted about pivot axis 31 which in turn causes the pivoting, free end 33 of bracket means 28 to be pivoted in the direction of arrow 74. Since front or drive wheels 34 are supported on the free end 33 of bracket means 28, as described above, such drive wheels are pushed deeper into the relatively increased carpet pile height so as to correspondingly increase the propelling force obtained with the driven wheels 34.

At the same time, because front support wheels 34 are in contact with flooring 70, the front portion 20 of chassis 12 is pivoted about rear axis 16 thereof in the direction of arrow 76. Such upward pivoting of chassis front portion 20 tends to increase the distance between underside 32 thereof and floor 30 so that the relatively increased carpet pile height 70 does not interfere with operation of bar 18 and vacuum nozzle area 26. If such height elevation regulation were not provided, proper air flow could be disturbed by the front portion 20 of chassis 12 sucking down onto the floor. Excessive bite into the carpet pile 70 can greatly increase the amount of push force required to propel chassis 12 relative the flooring to be cleaned, and in the worst case can completely block needed air flow for cleaning. In such instance, the drive wheels may actually sit and spin without physically moving the cleaner head at all, which obviously completely defeats the purpose of a self-propelled unit (and makes impossible proper operation of even a non-self-propelled unit).

Since planar portion 62 extends rearwardly beyond pivot axis 31, the desired pivoting action described above may be achieved. Furthermore, such pivoting action is continuous over its established range so that adjustment of both the propelling force and the chassis front height elevation is correspondingly continuous, thereby providing optimized self-adjusting features.

Present FIG. 5 illustrates operation of the present invention responsive to a further increased carpet pile height 78. Carpet pile height 78 is generally representative of shag-type carpets, which may be as long as 1¼ inches, or even longer. In generally the same manner of operation illustrated in present FIG. 4, planar sensing member 62 is pivoted still further in the direction of arrow 72 which correspondingly increases the downward pressure on wheel 34 in the direction of arrow 74 while also increasing upward rotation of chassis 12 about pivot axis 16 in the direction of arrow 76.

While the progression of present FIGS. 3 through 5 represents operation of the present invention responsive to increasing carpet pile heights, those of ordinary skill in the art, and to whom this disclosure is addressed, will understand that the automatic features of the present invention will operate in the reverse sense so as to relatively reduce propelling force with wheels 34 responsive to decreasing carpet pile heights. Similarly, the front portion 20 of chassis 12 will be correspondingly lowered (i.e. in a direction opposite to that of arrow 76) responsive to such decreasing carpet pile heights.

The foregoing discussion of automatic regulation functions of the present invention is particularly applicable whenever drive wheels 34 are driven in a forward rotatable direction thereof (i.e. in the direction of arrow 80). However, as mentioned above, drive wheels 34 may alternatively be controllably driven in a reverse direction for propelling chassis 12 in the direction of arrow 56. In such instance, in the absence of planar member 62, drive wheels 34 would tend to climb under chassis 12 towards the rearward end thereof, and cause pivot arm 64 of bracket means 28 to likewise pivot rearwardly about pivot axis 31. Not only is chassis under-climbing of the drive wheels obviously undesirable, but such rearward pivoting of bracket means 28 would tend to cause chassis front portion 20 to be raised excessively in an upward direction. However, with extended planar member 62 present, a stop means is provided during reverse rotation of drive wheels 34 which limits action of bracket means 28 and prevents such underfolding of the drive wheels when driving in reverse.

Additional advantages are achieved with practice of the present invention. For example, since a practical front wheel drive self-propelled unit is provided, rear wheels 14 may be left freely-rotatable so that the upright portion of an upright style vacuum cleaner (such as the representation of a handle and bag indicated by reference character 82) may be used to tilt chassis 12 backward for transport thereof on only the rear wheels. As discussed in the Background and Summary sections of the present application, such construction advantageously eliminates the need for any neutral clutch position for more typically driven rear wheels of self-propelled units.

Yet a further advantage of the present invention is achieved with preferred placement of the drive transmission also on the pivoting bracket means 28. Such construction, together with the relatively forward location of such drive transmission means (compared with rear wheel driven units having their drive transmission also rearwardly located), increases the amount of space available between the rear wheels for the motor blower instead of such drive transmission. The resulting structure provides a practical front wheel drive self-propelled unit which has a floating cleaning head, which head is automatically adjustable in the several senses discussed above.

While a specific exemplary embodiment of the present invention has been discussed above in detail, various modifications thereto may be practiced without departing from the spirit and scope of the present invention. For example, the sensing member or skid plate 58 may assume various forms which achieve the same sensing, pivoting, and stop means functions outlined above. Virtually any formation of a skid plate in accordance with the present invention is acceptable which advantageously provides varying downward pressure on generally forwardly located drive wheels so that the self-propelled unit does not lose its propelling forces with increasing carpet pile heights. Without such sensing member, the drive wheels would be free to pivot upward into the chassis until the bottom surface of the chassis itself were resting on the carpet, in which case there would be a complete loss of propelling forces. All modifications and variations to the present invention are intended to be included aspects thereof.

Furthermore, although specific language has been used in describing the presently disclosed exemplary preferred embodiment of this invention, all such language is intended by way of description and example only, and is not intended to limit the present invention, which is described more particularly in the appended claims.

What is claimed is:

1. A floor cleaning apparatus having a floating cleaning head comprising:

a chassis;

first support wheels, mounted generally rearwardly on said chassis, and having a substantially fixed axis of rotation;

a vacuum nozzle region, located generally forwardly on said chassis;

second support wheels, mounted on said chassis intermediate said first support wheels and said vacuum nozzle region, and having a movable axis of rotation which is movable in a substantially vertical plane relative a floor to be cleaned and on which said cleaning head is adapted to be received;

drive means for controllably rotating said second support wheels so as to propel said chassis over a floor to be cleaned; and automatic regulation means for varying the amount of propelling force transmitted through said second support wheels from said drive means to a floor to be cleaned, responsive to variations in the carpet pile height of such floor.

2. An apparatus as in claim 1, further comprising:

a rotatable beater bar brush mounted on said chassis generally in said vacuum nozzle region; and wherein said automatic regulation means includes sensor means for sensing carpet pile height of a floor to be cleaned, and includes pivoting means responsive to such sensed heights for moving said movable axis of rotation for said second support wheels so as to generally increase downward force on said second support wheels responsive to thicker carpet piles, which also tends to pivot said chassis about said fixed axis of rotation so as to raise the generally forward portion of said chassis for increasing the height of the vacuum nozzle region and beater bar brush for such thicker carpet piles.

3. An apparatus as in claim 2, wherein the axes of rotation for said first and second support wheels and said rotatable beater bar brush, and the pivot axis of said pivoting means are all parallel to one another.

4. An apparatus as in claim 1, wherein said automatic regulation means includes a pivoting bracket supported on said chassis intermediate said first support wheels and said vacuum nozzle region for supporting said second support wheels and said drive means on a pivoting, free end thereof, whereby movement of said second support wheels about the pivoting axis of said bracket while in contact with a floor to be cleaned also causes pivoting of the forward portion of said chassis about the fixed axis of said first support wheels which thereby automatically regulates the height of said chassis vacuum nozzle region responsive to variations in carpet pile height.

5. An apparatus as in claim 4, wherein said automatic regulation means further includes a skid plate fixedly secured to the pivoting, free end of said pivoting bracket, and extending therefrom generally rearwardly of said pivoting axis thereof and beneath said chassis adjacent a floor to be cleaned so that relatively thicker carpet piles increasingly push upwardly on said skid plate which in turn acts as a lever arm for pivoting said bracket generally towards the rear of said chassis, whereby said second support wheels are pushed deeper into relatively thicker carpet piles for increasing the propelling force thereof.

6. An apparatus as in claim 5, wherein said skid plate includes a cradle-like member for protectively enclosing the underside of said drive means while fixedly secured to the pivoting, free end of said bracket, and further includes an extended generally planar member integrally associated with said cradle-like member for contacting carpet pile of a floor to be cleaned and for defining a pivot arm for actuation of the pivoting of said bracket about the pivot axis thereof.

7. An apparatus as in claim 5, wherein, during rotation of said second support wheels for propelling said chassis in a rearward direction, said skid plate limits pivoting of said bracket adequate to prevent said second support wheels from folding under said chassis and to prevent excessive lifting of said vacuum nozzle region from the floor to be cleaned.

8. An apparatus as in claim 1, wherein said drive means includes a clutch-operated gear drive system adapted to be powered by motor means fixedly supported on said chassis.

9. An apparatus as in claim 1, wherein said automatic regulation means varies the amount of said propelling force within a continuous range responsive to variations in the carpet pile height.

10. A floating cleaner head for a self-propelled vacuum cleaner, comprising:

a main chassis adapted to be pivoted about a rearwardly located first axis thereof;

a rotary brush and vacuum nozzle means situated generally adjacent the front of said chassis;

freely-rotatable rear wheels for supporting said chassis, said rear wheels having a fixed axis of rotation coincident with said chassis first pivot axis;

pivoting bracket means, pivotably supported on said chassis about a second axis thereof located intermediate said rear wheels and said chassis front;

drive wheels for further supporting said chassis and drive transmission means for controllably driving said drive wheels so as to propel said chassis relative a floor to be cleaned, both said drive wheels and said drive transmission means being supported on said pivoting bracket means for movement therewith; and sensor plate means, associated with said pivoting bracket means for automatically pivoting same about said chassis second axis responsive to varying carpet pile height on which said cleaner head is used so as to in turn adjust the position of said drive wheels relative said chassis, whereby said drive wheels are pivoted deeper into the carpet pile with corresponding increases in such carpet pile height so as to provide increased propelling force.

11. A cleaner head as in claim 10, wherein, whenever said drive wheels are in contact with a floor to be cleaned, pivoting of said pivoting bracket means also causes said main chassis to be pivoted about said first axis thereof so that the height of said rotary brush and said vacuum nozzle means above the floor to be cleaned is automatically regulated.

12. A cleaner head as in claim 10, wherein:

during positive rotation of said drive wheels, said sensor plate means operates to adjust the position of said drive wheels relative said chassis responsive to variations in carpet pile height; and during reverse rotation of said drive wheels, said sensor plate means further operates to prevent folding of said drive wheels under said cleaner head and to prevent resultant lifting up of said main chassis front.

13. A cleaner head as in claim 10, wherein said sensor plate means continuously varies the position of said drive wheels relative said chassis responsive to analog variations in carpet pile height.

14. A cleaner head as in claim 10, wherein said sensor plate means is operative over a range of from about 0.25 inches to about 1.5 inches of carpet pile height.

15. A cleaner head as in claim 10, wherein said sensor plate means comprises a generally planar runner, having a cupped portion for enclosing the underside of said drive transmission means, with side openings adapted for the receipt of drive shafts interconnecting said drive transmission means and said drive wheels, and further having a floor contact portion extending rearwardly of said chassis second axis so that upward pressure on said floor contact portion caused by relatively thicker carpet pile causes said drive wheels to be pivoted downward into such relatively thicker carpet pile with resultant increased propelling force for said chassis.

16. A self-propelled upright vacuum cleaner having a floating cleaning head for automatic height adjustment thereof, comprising:

a generally planar chassis member adapted to be received on and propelled over a floor to be cleaned;

a control handle for controlling said vacuum cleaner and supporting a dust bag mounted thereon, said handle being pivotably attached to said chassis member for guiding same from a generally upright position;

rear support wheels for said chassis member, said rear wheels having a fixed rotation axis;

a vacuum nozzle area located adjacent the front of said chassis member;

a rotary beater bar brush situated in the vicinity of said vacuum nozzle area;

a support bracket pivotably mounted on said chassis member about a pivot axis situated parallel to said fixed rotation axis of said rear support wheels and located forwardly thereof, said bracket having a free pivoting end which projects generally forwardly of said pivot axis thereof;

drivable support wheels for said chassis member, secured on said bracket free pivoting end for pivoting movement therewith relative said chassis member and a floor to be cleaned;

drive transmission means, also supported on said bracket free pivoting end, in operative association with said drivable support wheels for controllably rotating same so as to propel said chassis member relative a floor to be cleaned; and a substantially rigid sensing member attached to said bracket at a fixed angle, and extending rearwardly of said pivot axis thereof and generally parallel with a floor to be cleaned, said sensing member being adapted for contacting carpet pile of a floor to be cleaned and thereby pivot said bracket about said pivot axis thereof to a degree corresponding with the relative thickness of the contacted carpet pile; whereby said bracket free pivoting end is pivoted downward with increasing carpet pile thickness so as to push said drivable support wheels deeper into such relatively thicker pile carpets, which relatively increases the propelling force obtained with said drivable support wheels in thicker pile carpets while also tending to pivot the front of said chassis member upward about said fixed axis of said rear support wheels so as to relatively raise the front rotary brush and vacuum nozzle area for such thicker pile carpets, and vice versa.

17. A vacuum cleaner as in claim 16, wherein said sensing member comprises a skid plate of integral molded plastic construction, having a first generally encasing portion for being fitted to the underside of said drive transmission means, and a second generally flattened portion for contacting the carpet pile of a floor to be cleaned, said skid plate further including attachment means for relatively rigidly securing same to one of said support bracket and said drive transmission means.

18. A vacuum cleaner as in claim 17, wherein said drivable support wheels comprise a pair of wheels on opposing ends of a drive axle which traverses said encasing portion of said skid plate, and wherein said drive transmission means is situated about said drive axle within said encasing portion of said skid plate.

19. A vacuum cleaner as in claim 16, wherein said sensing member is operative for said contacting and said subsequent pivoting of said bracket whenever said drivable support wheels are controllably rotated by said drive transmission means in a relatively forward direction, while providing a stop means for preventing said drivable support wheels from climbing rearwardly under said chassis member during relatively reverse rotation of said drivable support wheels by said drive transmission means.

* * * * *